US011753905B2

(12) United States Patent
Dusterhoft et al.

(10) Patent No.: US 11,753,905 B2
(45) Date of Patent: Sep. 12, 2023

(54) DOWNHOLE TOOL ACTUATOR WITH VISCOUS FLUID CLEARANCE PATHS

(71) Applicant: Halliburton Energy Services, Inc., Houston, TX (US)

(72) Inventors: Ross Glen Dusterhoft, Carrollton, TX (US); Brad Richard Pickle, Pottsboro, TX (US); Leo Guadalupe Collins, Farmers Branch, TX (US); Adam Evan Beck, Flower Mound, TX (US); Matthew Lawrence Apiecionek, Frisco, TX (US); Michael Wade Meaders, Pilot Point, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 151 days.

(21) Appl. No.: 17/216,066

(22) Filed: Mar. 29, 2021

(65) Prior Publication Data

US 2022/0307348 A1 Sep. 29, 2022

(51) Int. Cl.
*E21B 34/14* (2006.01)
*E21B 34/10* (2006.01)

(52) U.S. Cl.
CPC ..... *E21B 34/14* (2013.01); *E21B 34/10* (2013.01); *E21B 2200/05* (2020.05)

(58) Field of Classification Search
CPC ..... E21B 34/14; E21B 23/006; E21B 34/102; E21B 2200/05; E21B 34/10
See application file for complete search history.

(56) References Cited

U.S. PATENT DOCUMENTS 4,641,707 A * 2/1987 Akkerman ..... E21B 34/102 166/143
4,834,183 A 5/1989 Vizant et al.
4,986,357 A * 1/1991 Pringle ..... E21B 34/10 166/321
5,263,683 A 11/1993 Wong
7,255,174 B2 8/2007 Thompson
7,302,860 B1 12/2007 Uhlik et al.
7,493,956 B2 2/2009 Shaw et al.
(Continued)

FOREIGN PATENT DOCUMENTS

EP 1627988 2/2006
WO 2020-242446 12/2020

OTHER PUBLICATIONS

International Search Report and Written Opinion for Application No. PCT/US2021/026014, dated Dec. 10, 2021.

*Primary Examiner* — Robert E Fuller
(74) *Attorney, Agent, or Firm* — Scott Richardson; C. Tumey Law Group PLLC

(57) ABSTRACT

A flow tube is axially moveable within an actuator body between a first axial position and a second axial position for actuating a downhole tool, such as for closing a subsurface safety valve. The flow tube includes an interior flow bore for conveying fluids from the tubing string through the actuator body. An external flow tube profile defined on the flow tube includes an upper shoulder for engagement with a wiper in the first axial position, a lower shoulder for engagement with the wiper in the second axial position, and a clearance path between the upper and lower shoulders for allowing viscous flow past the wiper when the flow tube is moved between the first and second axial positions.

18 Claims, 6 Drawing Sheets

(56) References Cited

U.S. PATENT DOCUMENTS

| | | | | |
|---|---|---|---|---|
| 7,896,082 | B2 * | 3/2011 | Lake | E21B 37/06 166/332.8 |
| 8,353,353 | B2 * | 1/2013 | Reaux | E21B 34/10 166/373 |
| 9,352,247 | B2 | 5/2016 | Apiecionek et al. | |
| 2016/0138365 | A1 * | 5/2016 | Vick, Jr. | E21B 34/10 166/321 |
| 2019/0309601 | A1 * | 10/2019 | Grieco | E21B 43/267 |

* cited by examiner

DOWNHOLE TOOL ACTUATOR WITH VISCOUS FLUID CLEARANCE PATHS

BACKGROUND

Hydrocarbon fluids such as oil and gas are produced from wells drilled into an underground hydrocarbon formation. Wells are drilled to great depths into a hostile environment of temperature, pressure, and fluid chemistry, so the industry is constantly in pursuit of reliable ways to control downhole equipment from the surface. A variety of downhole tools that are used to construct and service wells rely on mechanical actuation. These tools may be lowered on a tubing string and then actuated to perform some tool function, such as closing a valve. One type of actuation is mechanical actuation involving axial movement of a piston. This type of actuation can be convenient and reliable because it allows a downhole tool to be controlled by personnel or machinery located above ground by supplying pressurized hydraulic fluid downhole from the surface.

An example of a downhole tool that may be controlled by mechanical actuation is a subsurface safety valve. After the well is drilled and completed, the hydrocarbon fluids produced from the formation may be conveyed to surface through production tubing installed downhole. Surface-controlled subsurface safety valves (SSSVs), for example, are used to selectively close off lower portions of the flowbore of a production tubing string in the event of an emergency. These valves can then be reopened later when the emergency has been remedied and it is desired to reestablish flow. For example, in response to an accident, a control action at the surface, or otherwise a decrease of hydraulic fluid pressure, the safety valve can be closed to seal the flow of fluid from the formation.

BRIEF DESCRIPTION OF THE DRAWINGS

These drawings illustrate certain aspects of some of the embodiments of the present disclosure and should not be used to limit or define the method.

DETAILED DESCRIPTION

The present disclosure includes an actuator and method for a downhole tool that provides a clearance path for viscous fluids to bypass a wiper to prevent them from retarding component movement within the downhole tool. The wiper normally helps keep out fluids and contaminants from entering the space between certain components (e.g., a flow tube) and the tool body. The clearance paths are provided to allow for any trapped fluids or contaminants to bypass the wiper when actuating the downhole tool.

Specific example embodiments include a subsurface safety valve (SSV) having a flow tube for actuating a valve closure element and a reduced-diameter clearance paths defined in an upper flow tube extension. The flow tube is moveable between a first axial position (valve open) to a second axial position (valve closed). A wiper ring between the flow tube and tool body engages respective shoulders on the flow tube in the first and second axial positions to keep out fluid and contaminants when in the first and second axial positions. The clearance paths axially between the shoulders allow viscous fluid and other contaminants to pass under the wiper as the flow tube moves between the first and second axial positions.

A number of different example configurations are disclosed for the clearance paths. One example includes axially-extending channels along an external flow tube profile. Another example includes axially-extending flats that cut across a circular outer portion of the external flow tube profile. Yet another example includes a continuous reduced-diameter portion between the shoulders.

Figure 1:
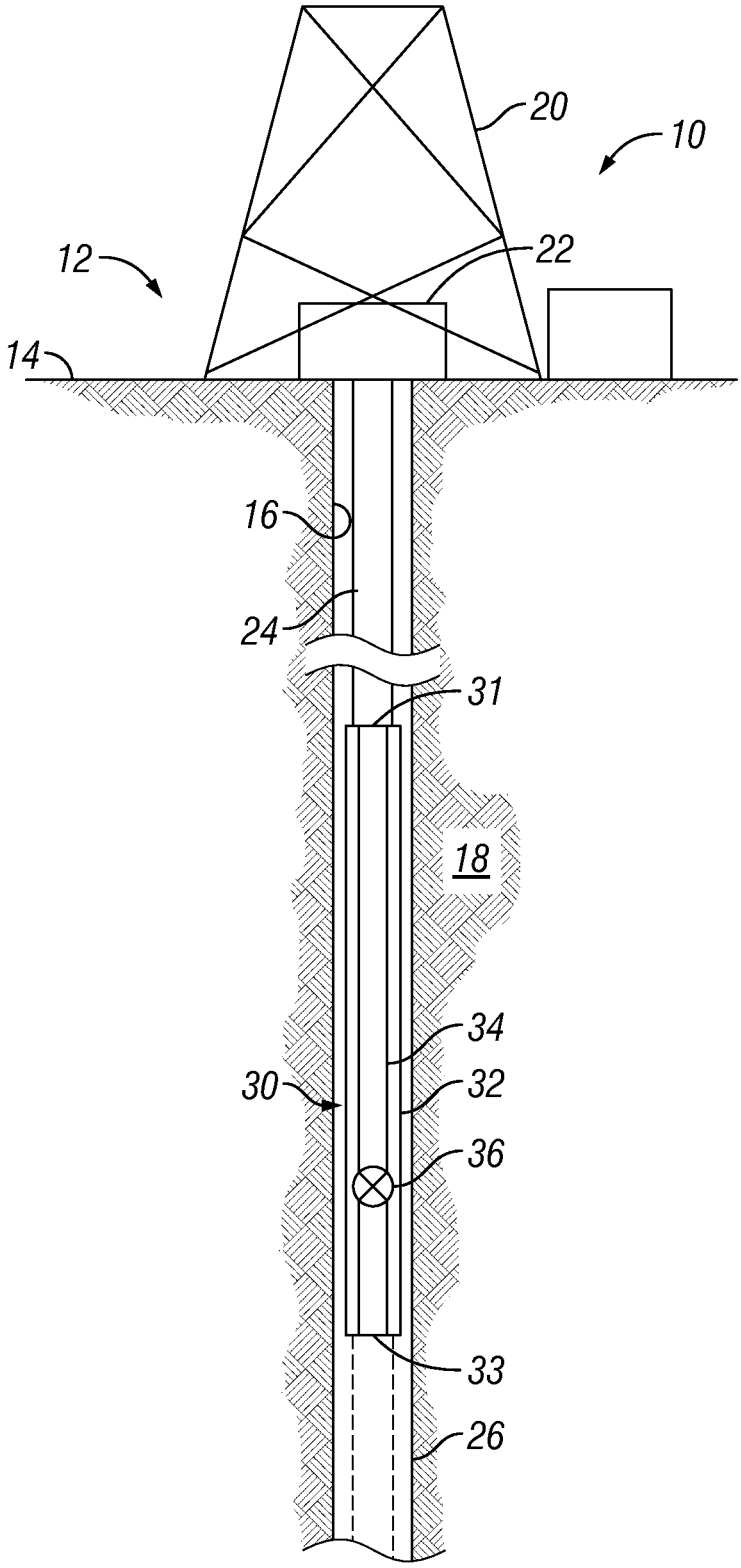
FIG. 1 is an elevation view of an example well site in which a mechanically actuatable downhole tool according to the present disclosure may be used.

FIG. 1 is an elevation view of an example well site 10 setting forth the general environment and context in which a mechanically actuatable downhole tool 30 according to the present disclosure may be used. The well site 10 may include an oil and gas rig 12 arranged at the earth's surface 14 and a wellbore 16 extending therefrom and penetrating a subterranean earth formation 18. The rig 12 may include a large support structure such as a derrick 20, erected over the wellbore 16 on a support foundation or platform, such as a rig floor 22. Even though certain drawing features of FIG. 1 depict a land-based oil and gas rig, it will be appreciated that the embodiments of the present disclosure are useful with other types of rigs, such as offshore platforms or floating rigs used for subsea wells, and in any other geographical location. For example, in a subsea context, the earth's surface 14 may be the floor of a seabed, and the rig floor 22 may be on the offshore platform or floating rig over the water above the seabed. A subsea wellhead may be installed on the seabed and accessed via a riser from the platform or vessel.

The wellbore 16 may be drilled along a desired wellbore path to reach a target formation, such as to avoid non-desirable formation features, to minimize footprint of the well at the surface, and to achieve any other objectives for the well. Although the illustrated portion of the wellbore 16 is vertically downward, the wellbore may deviate in any direction with varying azimuth and inclination, which may result in sections that are vertical, horizontal, angled up or down, and/or curved. The term uphole generally refers to a direction along the wellbore path toward the surface 14, and the term downhole generally refers to a direction toward the bottom of the well, without regard to whether a feature is vertically upward or vertically downward with respect to a reference point.

The derrick 20 or other support structure may be used to help support and manipulate the axial position of a tubing string 24 such as to raise and lower it within the wellbore 16. The tubing string 24 may be made up of segments of oilfield tubulars such as drill pipe, casing, production tubing, or other tubular segments, and having any of a variety of tools for performing wellbore operations, such as drilling, completion, stimulation, or production. The tubing 24 string may serve various functions, such as a work string to lower and retrieve tools, completion or production tubing to convey fluids from or to the surface 14, and to support the conveyance of communication and power during wellbore operations. When a wellbore operation is to be performed, the tubing string may be progressively assembled on site and lowered into the wellbore, i.e., run/tripped into the wellbore 16. When a wellbore operation is complete, or when it becomes necessary to exchange or replace tools or components of the work string, the tubing string 24 in some cases may be raised or fully removed from the wellbore, i.e., tripped out of the hole.

In an example of a completion operation, the tubing string 24 may comprise a work string used to lower a completion string into the wellbore, including intervals of casing, and cement the casing in place. In an example of a formation stimulation operation, the tubing string 24 may comprise a frac tubing string for conveying proppant-laden fluids used in hydraulically fracturing the formation, or other treatment fluids and/or chemicals such as an acidizing treatment, to stimulate the flow of hydrocarbons from the formation 18. In an example of a production operation, the tubing string 24 may comprise production tubing lowered into the wellbore 16 and coupled to a lower completion string 26 above a production zone, so formation fluids such as oil and gas may flow through the production tubing to surface. In any of these examples, fluid may either flow from the well Aspects of the downhole tool 30 are generalized or schematically illustrated for discussion purposes in FIG. 1. The downhole tool 30 is actuated by an actuator that includes an actuator body 32 having an upper end 31 fluidically coupled (directly or indirectly) to the tubing string 24. A lower end 33 is fluidically coupled (directly or indirectly) to the wellbore 16 below the downhole tool 30, such as with a physical connection to a completion string component below the downhole tool 30 or even just open to the wellbore 16. The downhole tool 30 also has a through bore from the upper end 31 to the lower end 33, which may allow for tubular interior components to be positioned within the downhole tool 30 (e.g. tool or actuator components) and/or for fluids or objects to pass through the downhole tool 30. The actuator body 32 may be a shared structure with a tool body, providing an overall tubular structure that houses internal actuator components (e.g., a flow tube, a piston, etc.) and components of the tool 30 (e.g., valve closure element) actuated thereby.

A generally tubular actuator element referred to as the flow tube 34 is moveably disposed within the through bore of the actuator body 32. The generally tubular structure of the flow tube 34 conveys fluid through the downhole tool 30 to and/or from the tubing string 24. The flow tube 34 is also axially moveable within the actuator body 32, and may be driven by a piston 36 controlled from the surface 14 hydraulically, electrically, or otherwise, to actuate the tool 30. Actuating the tool 30 may involve using the axial displacement of the flow tube 34 to perform some tool function. For example, if the downhole tool 30 comprises a valve, the tool function may comprise moving a valve element from an open position to a closed position or vice-versa, in response to axial movement of the flow tube 34 within the actuator body 32.

An example of a mechanically-actuatable downhole tool is discussed below. However, one of ordinary skill in the art will appreciate that other downhole tools may be similarly actuated in accordance with this disclosure. Other such tools may include, for example, downhole internal control valves (ICVs), flow control equipment, and circulation and production sleeves.

Figure 2:
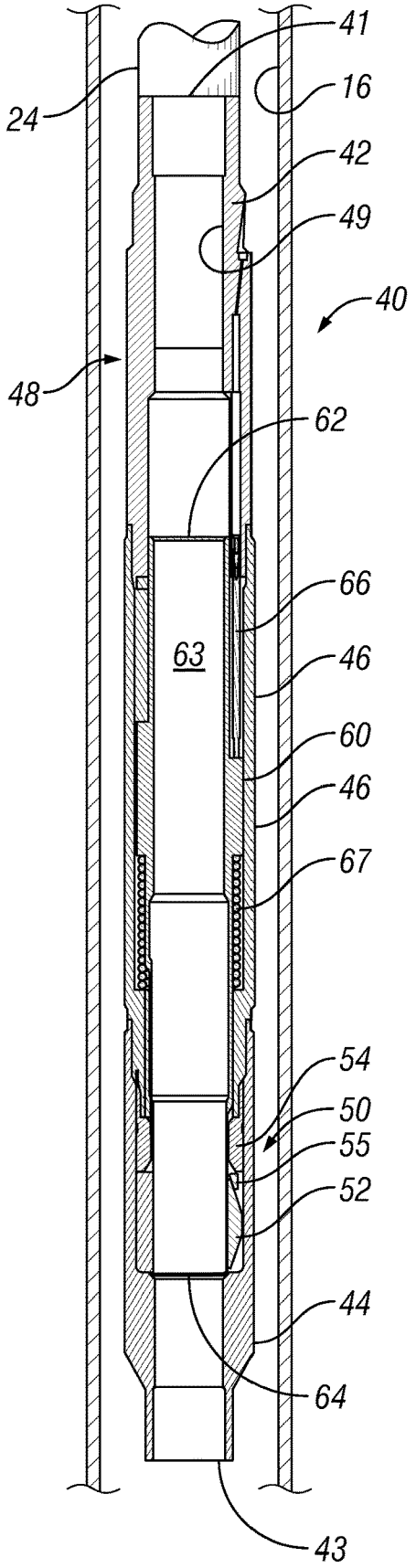
FIG. 2 is a sectional side view of a subsurface safety valve (SSV) in an open state within the wellbore.

FIG. 2 is a cross-sectional side view of a subsurface safety valve (SSV) 40 in an open state within the wellbore 16. The SSV 40 is one example of a downhole tool operable by axial motion of a flow tube according to this disclosure. The SSV 40 includes various components interconnected to form a generally tubular tool body 48, such as a tubular top sub 42, a tubular bottom sub 44, and any number of intermediate subs or other tubular members, such as a spring housing 46, interconnected therebetween. This tubular tool body 48 may simultaneously serve as the tool body and an actuator body, protecting components of the SSV 40 that perform a tool function, such as a flapper valve 50, and actuator components for actuating the tool to perform that function, such as closing or opening the valve. The tool body 48 has an upper end 41 for coupling to the tubing string 24, which may be production tubing of a completion string, a lower end 43 which may also be coupled to a tubing string such as production tubing and directly or indirectly in fluid communication with the wellbore 16 below the SSV 40, such as via the production tubing, and a through bore 49 between the upper end 41 and lower end 43.

The flapper valve 50 comprises an assembly of a valve closure element, embodied in this example as a flapper 52 and a seal 54 located near the lower end of the SSV 40. The flapper 52 is pivotable about a hinge 55 between the open position shown in FIG. 2 and a closed position in engagement with the seal 54. Although a flapper type valve is suitable for use with an SSV, the disclosure is not limited to flapper type valves. Any type of valve that includes a valve closure element actuatable in response to axial movement of a flow tube is also within the scope of this disclosure.

An actuator element referred to as the flow tube 60 is axially moveable within the through bore 49 of the tool body 48. The flow tube 60 has an upper end 62, a lower end 64, and an interior flow bore 63 therebetween to provide fluid flow. The flow tube 60 is also axially moveable when actuating the SSV 40. Any of a variety of actuator types suitable for axially displacing the flow tube 60 may be used. In this embodiment, downward axial movement of the flow tube 60 is imparted by a hydraulically-operated piston 66 disposed between the flow tube 60 and a spring housing 46 of the tool body 48. A spring 67 within the spring housing 46 may bias the flow tube 60 upward, which biasing force is overcome when a force is applied downwardly by the piston 66.

In FIG. 2, the flow tube 60 has been urged to, and is held in, a first axial position by the piston 66, propping the flapper 52 open. Propping the flapper 52 open allows fluid flow through the tool body 48 of the SSV 40, along the interior flow bore 63 of the flow tube 60. With the flapper 52 open as in FIG. 2, fluids may be delivered downhole through the tubing string 24 and/or uphole from the formation, past the open flapper valve 50 and through the SSV 40.

Figure 3:
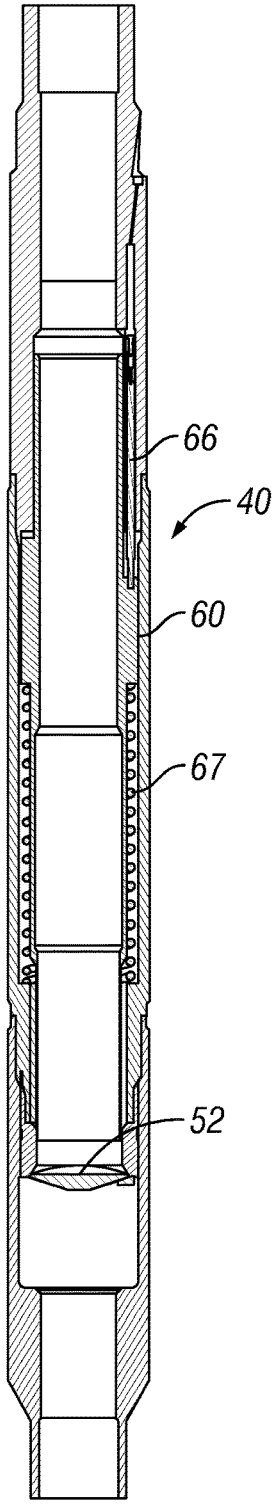
FIG. 3 is a sectional side view of the SSV in a closed state.

FIG. 3 is a sectional side view of the SSV 40 in a closed state. The flow tube 60 is in a second axial position upward of the first axial position of FIG. 2. Hydraulic pressure on the piston 66 has been eased, allowing the biasing action of the spring 67 to move the flow tube 60 upward to the second axial position. The flapper 52 has pivoted to a closed position in response to movement of the flow tube 60 to the second axial position, as the flow tube 60 is clear of the flapper 52 in the second axial position so as not to prop the flapper 52 open. The flapper 52 itself may be spring-biased by a torsional flapper spring to the closed position and/or urged to the closed position by upward fluid pressure acting on the flapper 52 from below. As a result of the flapper 52 closing, the SSV 40 is now in the closed state, preventing or minimizing flow through the SSV 40.

Figure 4:
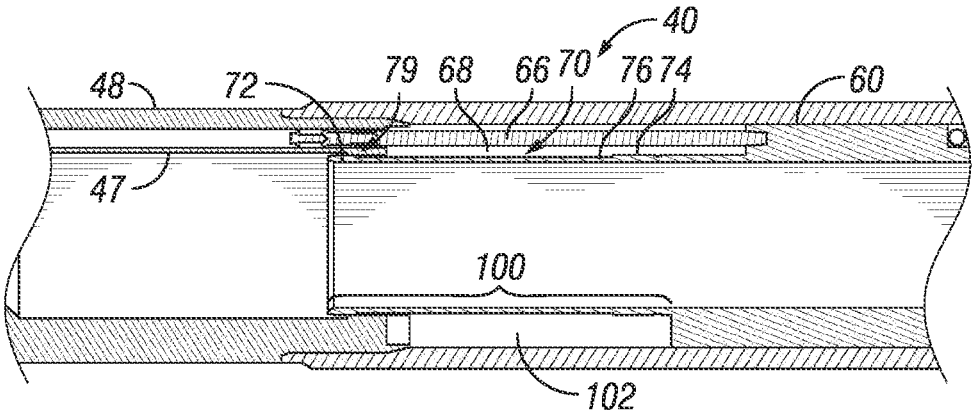
FIG. 4 is an enlarged view of a portion of the SSV further detailing the flow tube while in the first axial position (valve open).

FIG. 4 is an enlarged view of a portion of the SSV 40 further detailing the flow tube 60 while in the first axial position (valve open). The flow tube 60 fits closely with an inner diameter (ID) 47 of a portion of the generally tubular tool body 48, allowing relative movement between the flow tube 60 and tool body 48. A narrow annulus 68 between the flow tube 60 and the ID 47 of the tool body 48 is potentially exposed to fluids and other contaminants from the downhole environment. A wiper 79, which comprises in this example a generally circular wiper ring, is disposed between flow tube 60 and the ID 47 of the tool body 48 in an effort to minimize the entry of fluids and contaminants into that annulus 68. However, viscous fluid and contaminants may migrate past the wiper 79 over time and accumulate at the annulus 68. These viscous fluid and contaminants may conventionally increase resistance to sliding motion between closely-fitting moveable parts.

The flow tube 60 includes a flow tube extension 100. A portion of the flow tube 60 from which the flow tube extension 100 extends is wider than the portion of the flow tube 60 below the flow tube extension 100. The flow tube 60 below the flow tube extension 100 rides in a wider portion of the tool body 48 than the flow tube extension 100, with an annular volume 102 defined between the flow tube extension 100 and the wider portion of the tool body when the flow tube is in the first axial position. When moving the flow tube 60 toward the second axial position (to the left in FIG. 4), the flow tube 60 will move into and fill at least a portion of that annular volume 102, which may squeeze out fluid trapped in the annular gap and force that squeezed out fluid past the wiper 79.

An external flow tube profile 70 is formed on the flow tube 60 to mitigate the possibility of the flow tube 60 becoming stuck or slowing response time due to any viscous fluid or contaminants in the annulus 68. In this example, the external flow tube profile 70 is formed on a flow tube extension 100 of the flow tube 60. Generally, the external flow tube profile 70 is formed so that the wiper 79 is engaged with the outer diameter (OD) of the flow tube in the first axial position corresponding to the open valve (as in FIGS. 4 and 5) and also in the second axial position corresponding to the closed valve (as in FIG. 7). More particularly, the external flow tube profile 70 has an upper shoulder 72 for engagement with the wiper 79 in the first axial position and a lower shoulder 74 for engagement with the wiper 79 in the second axial position. That is, an ID of the wiper 79 (e.g. a wiper ring thereof) may contact an OD of the shoulders 72, 74, such as with a contact or slight interference fit. Thus, the wiper 79 may effectively minimize migration of fluid and contaminants between the wiper ring 80 and flow tube 60 while the valve is open or closed. The external flow tube profile 70 further includes a reduced-diameter portion that serves as a clearance path 76 extending axially between the upper and lower shoulders 72, 74. This reduced-diameter clearance path 76 provides clearance to allow for viscous fluid to pass under the wiper 79 when the flow tube is in-between the first and second axial positions, to reduce resistance to movement of the flow tube 60 that a viscous fluid would otherwise cause during actuation to open or close the SSV 40. Any accumulated viscous fluids in the annulus 68 may more easily flow under the wiper 79 along the reduced-diameter clearance path 76 when moving the flow tube 60 between the first and second axial positions.

Figure 5:
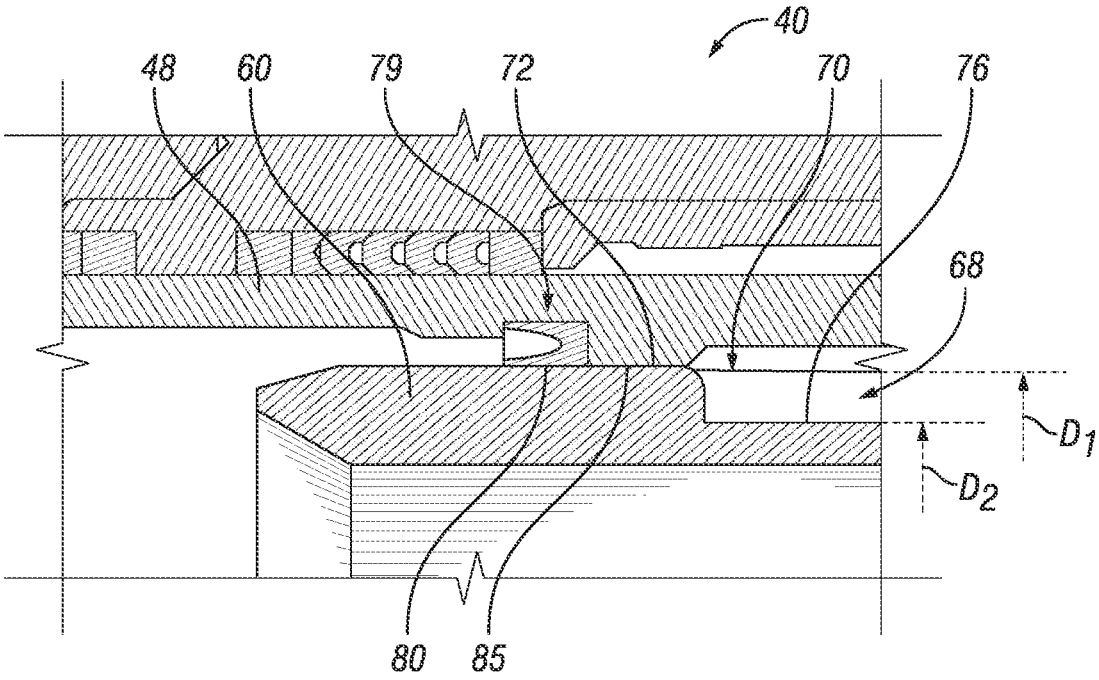
FIG. 5 is a further enlarged view of the SSV detailing a portion of the external flow tube profile while in the first axial position (valve open).

FIG. 5 is a further enlarged view of the SSV 40 detailing a portion of the external flow tube profile 70 while in the first axial position (valve open). As can be seen in this enlarged view, the wiper 79 may comprise a wiper ring 80 seated on a wiper seat 85. The wiper seat 85 may be a rigid structure, optionally formed on the tool body 48, that supports the wiper ring 80 and occupies the bulk of any gap between tool body and the upper shoulder 72 in the first position, without necessarily directly contacting the upper shoulder 72. The wiper ring 80 may be a compliant element that directly engages the upper shoulder 72. The diameter "D1" of the upper shoulder 72 is sized so that the external flow tube profile 70 is in contact with the wiper ring 80 at that location. The wiper ring 80 may engage the entire circumference of the flow tube 60 at the upper shoulder 72. The reduced diameter clearance path 76 has a lesser diameter "D2" than the diameter D1 of the upper shoulder 72.

Figure 6:
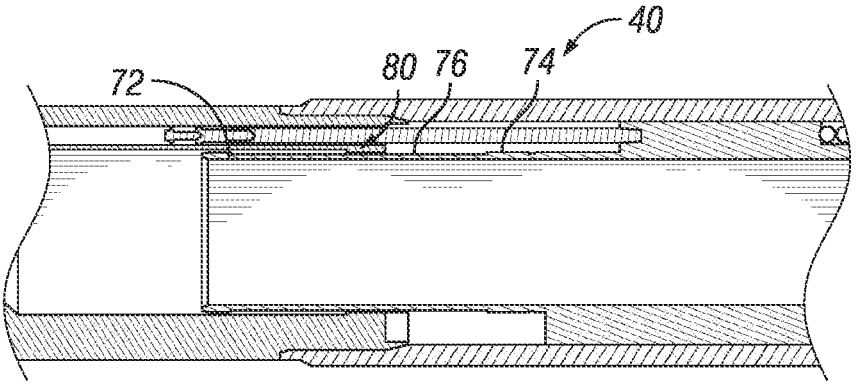
FIG. 6 is an enlarged view of the SSV with the flow tube in-between the first axial position (valve open) and the second axial position (valve closed).

FIG. 6 is an enlarged view of the SSV 40 with the flow tube in an intermediate position, which is in-between the first axial position (valve open) and the second axial position (valve closed). This positions the wiper ring 80 along the reduced diameter clearance path 76 of the external flow tube profile, somewhere between the upper and lower shoulders 72, 74. The clearance path thus comprises an annular gap defined between the flow tube 60 and the wiper ring 80 so that trapped viscous fluids will migrate under the wiper ring 80 along the reduced diameter clearance path 76 of the external flow tube profile 70. In one range of examples, the annular gap between the flow tube 60 and the wiper ring 80 at the shoulders 72, 74 is essentially zero (no gap, with optionally sealing contact) and the annular gap between the flow tube 60 and the wiper ring 80 at the reduced diameter clearance path 76 is greater than 10 mm (0.4 inch). The reduced diameter clearance path 76 may take any of a variety of configurations as detailed in specific examples that follow.

Figure 7:
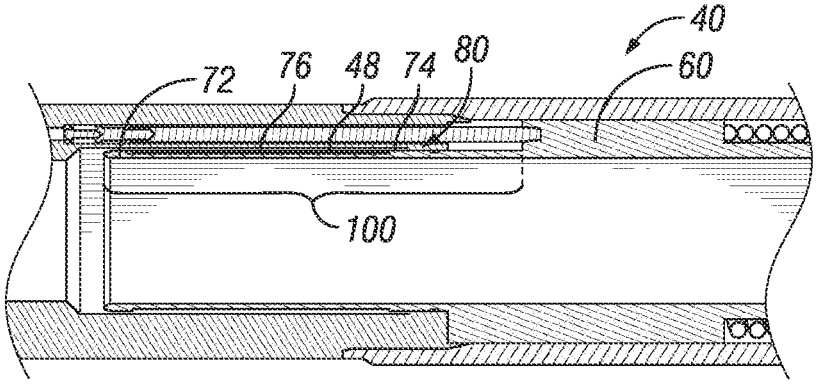
FIG. 7 is an enlarged view of a portion of the SSV further detailing the flow tube having moved to the second axial position (valve closed).

FIG. 7 is an enlarged view of a portion of the SSV 40 further detailing the flow tube 60 having moved to the second axial position (valve closed) of FIG. 3. Now, the lower shoulder 74 of the external flow tube profile 70 is in contact with the wiper ring 80. The lower shoulder 74 is sized so that the external flow tube profile 70 is in contact with the wiper ring 80 at that location; the lower shoulder 74 may have the same diameter as the upper shoulder 72. The wiper ring 80 may engage the entire circumference of the flow tube 60 at the lower shoulder 74 to help minimize fluid ingress past the wiper ring 80 between the flow tube 60 and tool body 48. Thus, whether in the first axial position (valve open) of FIG. 4 or second axial position (valve closed) of FIG. 7, the wiper ring 80 may operate to prevent or minimize migration of fluid and contaminants past the wiper ring 80. Only while between the first and second axial positions of the flow tube 60, such as briefly to open or close the valve, does the wiper ring 80 align somewhere along the reduced diameter clearance path 76.

Figure 8:
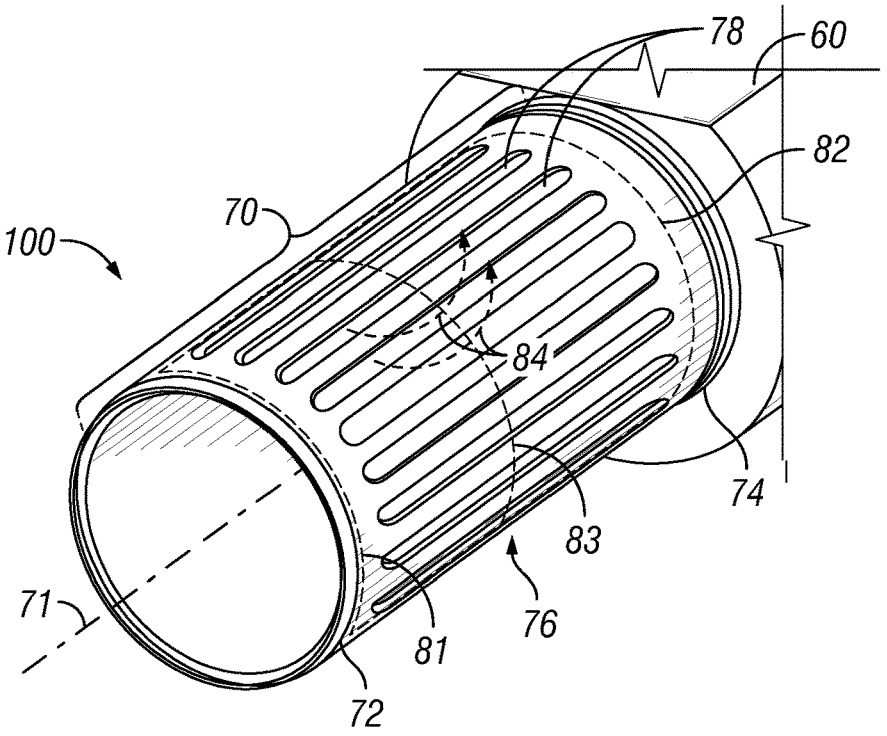
FIG. 8 is a perspective view of a flow tube extension wherein an external flow tube profile includes a plurality of axially extending channels.

FIG. 8 is a perspective view of the flow tube extension 100 defining an example of the external flow tube profile 70. The external flow tube profile 70 is generally circular about a central axis 71. The shoulders 72, 74 are circular in this and other examples of this disclosure, in which case a wiper ring that seals with or otherwise engages the shoulder 72 or 74 when the valve is open or closed would also be circular. However, the shoulders 72, 74 could also be non-circular (e.g., a regular geometric shape) in any of these examples if the wiper had a corresponding shape to conform therewith. The shoulders 72, 74 may coincide with the radially outermost portion of the external flow tube profile 70. The reduced diameter clearance path 76 in this example comprises a plurality of channels 78 axially extending along the external flow tube profile 70 between the first and second shoulders 72, 74. The interiors of the channels 78 are at a reduced diameter with respect to the shoulders 72, 74.

Three example positions 81, 82, 83 of the wiper ring relative to the flow tube extension 100 are shown in phantom lines, depending on the axial position of the flow tube 60. The first wiper ring position 81 corresponds to the flow tube being in the first axial position (open valve), wherein the wiper ring engages the first shoulder 72 and flow across the wiper is minimized. The second wiper ring position 82 corresponds to the flow tube being in the second axial position (closed valve), wherein the wiper ring engages the second shoulder 72 and flow across the wiper is also minimized. The third wiper ring position 83 corresponds to the wiper ring being in-between the first and second shoulders 72, 74, wherein viscous fluids can more easily pass under the wiper ring at each channel 78 as indicated at arrows 84.

Figure 9:
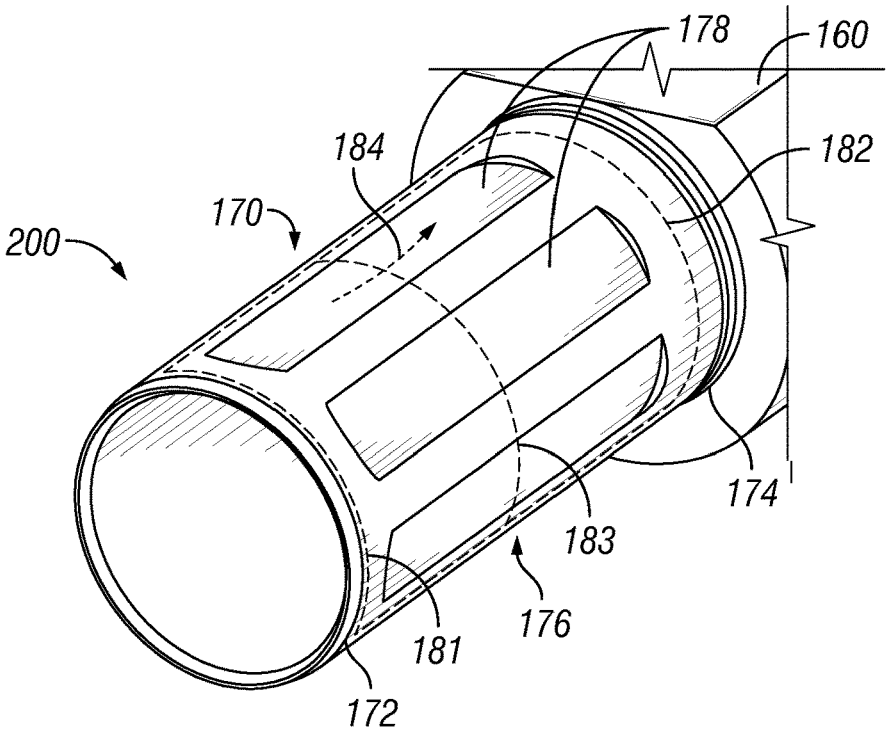
FIG. 9 is a perspective view of a flow tube extension wherein an external flow tube profile includes a plurality of flats.

FIG. 9 is a perspective view of a flow tube extension 200 of a flow tube 160 with another example of an external flow tube profile 170. A reduced diameter clearance path 176 comprises a plurality of flats 178 that cut across the generally circular outer portion of the external flow tube profile and which axially extend between the first and second shoulders 172, 174. Three example positions 181, 182, 183 for a wiper ring, depending on the axial position of the flow tube 160, are shown in phantom lines. The first wiper ring position 181 corresponds to the flow tube being in the first axial position (open valve), wherein the wiper ring engages the first shoulder 172 and flow across the wiper is minimized. The second wiper ring position 182 corresponds to the flow tube being in the second axial position (closed valve), wherein the wiper ring engages the second shoulder 174 and flow across the wiper is also minimized. The third wiper ring position 183 corresponds to the wiper ring being in-between the first and second shoulders 172, 174, wherein flow can pass under the wiper ring at each flat 178 as indicated at arrows 184.

Figure 10:
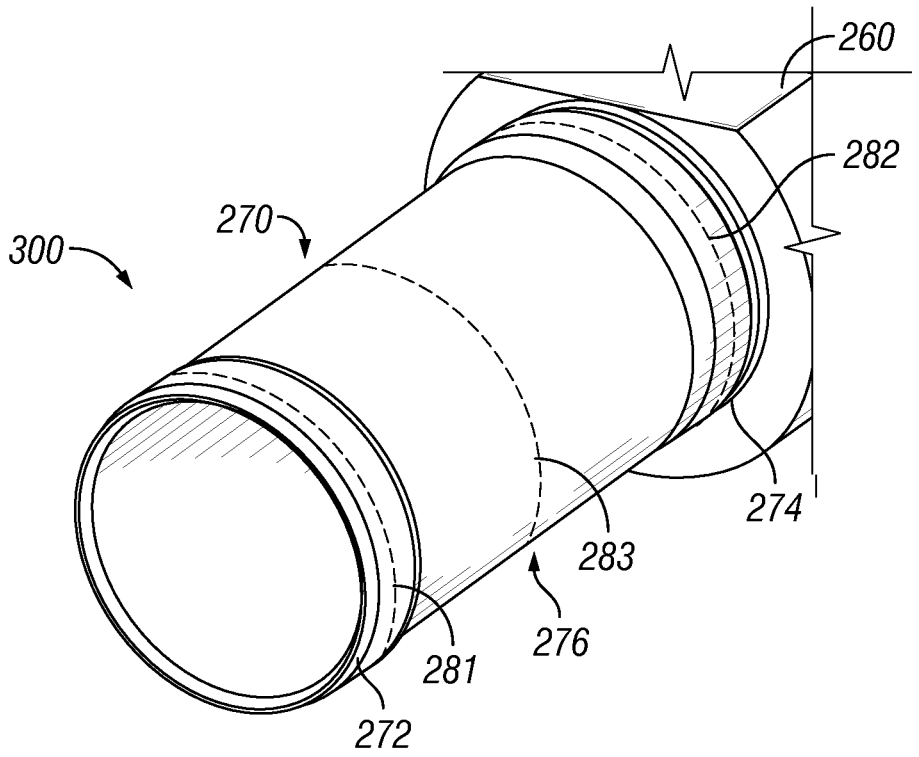
FIG. 10 is a perspective view of a flow tube extension wherein an external flow tube profile comprises a continuous reduced-diameter portion.

FIG. 10 is a perspective view of a flow tube extension 300 with a third example configuration of an external flow tube profile 270. A reduced-diameter clearance path in this example comprises a continuous, reduced-diameter portion 276 between the upper and lower shoulders 272, 274. The diameter of the reduced-diameter portion 276 is optionally constant along its length in this example, although the diameter may vary along its length and still be less than the diameters of the shoulder 272, 274. Three example positions 281, 282, 283 for a wiper ring, depending on the axial position of the flow tube 260, are shown in phantom lines. The first wiper ring position 281 corresponds to the flow tube being in the first axial position (open valve), wherein the wiper ring engages the first shoulder 272 and flow across the wiper is minimized. The second wiper ring position 282 corresponds to the flow tube being in the second axial position (closed valve), wherein the wiper ring engages the second shoulder 274 and flow across the wiper is also minimized. The third wiper ring position 283 corresponds to the wiper ring being in-between the first and second shoulders 272, 274, wherein, since the reduced-diameter portion is continuous, flow can pass under the wiper ring at any circumferential location on the reduced diameter portion.

Accordingly, the present disclosure provides a downhole tool, actuator, and method that utilize clearance paths for viscous fluids and other contaminants to bypass a wiper during actuator. A number of different external flow profiles and clearance paths are possible, of which the above are just some examples. Reliability is maintained, which is especially important for safety equipment such as subsurface safety valves. The disclosed tool, actuator, and method may include any of the various features disclosed herein, including one or more of the following statements.

Statement 1. A subsurface safety valve, comprising: a tool body positionable in a wellbore and having an upper end for coupling to a tubing string, a lower end, and a through bore between the upper and lower ends for conveying fluid; a valve closure element coupled to the lower end of the tool body and moveable between an open position and a closed position; a flow tube disposed in the tool body and axially moveable between a first axial position putting the valve closure element in the open position and a second axial position allowing the valve closure element to move to the closed position, the flow tube including an interior flow bore for conveying the fluid from the tubing string; and an external flow tube profile formed on the flow tube including an upper shoulder for engagement with a wiper in the first axial position, a lower shoulder for engagement with the wiper in the second axial position, and a clearance path between the upper and lower shoulders for allowing viscous flow past the wiper when the flow tube is in-between the first and second axial positions.

Statement 2. The subsurface safety valve of Statement 1, wherein the clearance path comprises a plurality of axially-extending, circumferentially-spaced channels along the external flow tube profile between the upper and lower shoulders.

Statement 3. The subsurface safety valve of Statement 1 or 2, wherein the clearance path comprises a plurality of axially-extending flats between the upper and lower shoulders.

Statement 4. The subsurface safety valve of any of Statements 1-3, wherein the clearance path comprises a continuous, reduced-diameter portion between the upper and lower shoulders.

Statement 5. The subsurface safety valve of any of Statements 1-4, wherein an annular gap between the flow tube and the wiper is at least 10 mm along the clearance paths.

Statement 6. The subsurface safety valve of any of Statements 1-5, further comprising: a flow tube extension extending from the flow tube; an upper shoulder along the flow tube extension defining the upper shoulder; and a lower shoulder along the flow tube extension defining the lower shoulder.

Statement 7. The subsurface safety valve of any of Statements 1-6, wherein the valve closure element comprises a flapper pivotable to an open position in response to positioning of the flow tube in the first axial position and to a closed position in response to positioning of the flow tube in the second axial position.

Statement 8. The subsurface safety valve of any of Statements 1-7, wherein the tool body comprises a top sub and a bottom sub for releasably coupling the tool body to a completion string.

Statement 9. The subsurface safety valve of Statement 1, wherein the flow tube comprises a flow tube extension on an upper end defining the clearance path of the external flow tube profile, wherein the wiper is positioned in an annulus between the flow tube extension and the tool body.

Statement 10. The subsurface safety valve of Statement 9, wherein a portion of the flow tube from which the flow tube extension extends is wider than the flow tube extension and rides in a wider portion of the tool body than the flow tube extension, with an annular gap defined between the flow tube extension and the wider portion of the tool body when the flow tube is in the first axial position, and wherein the flow tube fills at least a portion of the annular gap when moving to the second axial position to urge trapped fluid out of the annular gap and across the wiper.

Statement 11. The subsurface safety valve of any of Statements 1-10, wherein the wiper comprises a wiper ring supported on a wiper seat.

Statement 12. A downhole tool actuator, comprising: an actuator body disposable in a wellbore and having an upper end for coupling to a tubing string, a lower end, and a through bore between the upper and lower ends for conveying fluid; a flow tube disposed in the actuator body and axially moveable within the actuator body between a first axial position and a second axial position for actuating a downhole tool when coupled to the actuator body, the flow tube including an interior flow bore for conveying fluids from the tubing string through the actuator body; and an external flow tube profile defined on the flow tube including an upper shoulder for engagement with a wiper in the first axial position, a lower shoulder for engagement with the wiper in the second axial position, and a clearance path between the upper and lower shoulders for allowing viscous flow past the wiper when the flow tube is moved between the first and second axial positions.

Statement 13. The downhole tool actuator of Statement 12, wherein the tool comprises a valve including a moveable closure element moveable by the flow tube between an open position and a closed position.

Statement 14. The downhole tool actuator of Statement 12 or 13, wherein the clearance path comprises a plurality of axially-extending, circumferentially-spaced channels along the external flow tube profile between the upper and lower shoulders.

Statement 15. The downhole tool actuator of any of Statements 12-14, wherein the clearance path comprises a plurality of axially-extending flats between the upper and lower shoulders.

Statement 16. The downhole tool actuator of any of Statements 12-15, wherein the clearance path comprises a continuous, reduced-diameter portion between the upper and lower shoulders.

Statement 17. A method of operating a downhole tool, the method comprising: lowering the downhole tool into a wellbore on a tubing string; flowing a fluid through the tubing string and through a flow tube with the flow tube in a first axial position within a tool body; blocking flow between the flow tube and the tool body with a wiper while in the first axial position; moving the flow tube from the first axial position to a second axial position to actuate the downhole tool; and while moving the flow tube to the second axial position, passing fluid trapped between the flow tube and a body of the downhole tool under the wiper along a reduced-diameter clearance path between the flow tube and the tool body.

Statement 18. The method of Statement 17, wherein the step of passing fluid trapped between the flow tube and a body of the downhole tool under the wiper comprises passing the trapped fluid along a plurality of axially-extending, circumferentially-spaced channels along the flow tube.

Statement 19. The method of Statement 17 or 18, wherein the step of passing fluid trapped between the flow tube and a body of the downhole tool under the wiper comprises passing the trapped fluid along a plurality of axially-extending flats along the flow tube.

Statement 20. The method of any of Statements 17-19, wherein the step of passing fluid trapped between the flow tube and a body of the downhole tool under the wiper comprises passing the trapped fluid along a continuous, reduced-diameter portion of the flow tube.

For the sake of brevity, only certain ranges are explicitly disclosed herein. However, ranges from any lower limit may be combined with any upper limit to recite a range not explicitly recited, as well as, ranges from any lower limit may be combined with any other lower limit to recite a range not explicitly recited, in the same way, ranges from any upper limit may be combined with any other upper limit to recite a range not explicitly recited. Additionally, whenever a numerical range with a lower limit and an upper limit is disclosed, any number and any included range falling within the range are specifically disclosed. In particular, every range of values (of the form, "from about a to about b," or, equivalently, "from approximately a to b," or, equivalently, "from approximately a-b") disclosed herein is to be understood to set forth every number and range encompassed within the broader range of values even if not explicitly recited. Thus, every point or individual value may serve as its own lower or upper limit combined with any other point or individual value or any other lower or upper limit, to recite a range not explicitly recited.

Therefore, the present embodiments are well adapted to attain the ends and advantages mentioned as well as those that are inherent therein. The particular embodiments disclosed above are illustrative only, as the present embodiments may be modified and practiced in different but equivalent manners apparent to those skilled in the art having the benefit of the teachings herein. Although individual embodiments are discussed, all combinations of each embodiment are contemplated and covered by the disclosure. Furthermore, no limitations are intended to the details of construction or design herein shown, other than as described in the claims below. Also, the terms in the claims have their plain, ordinary meaning unless otherwise explicitly and clearly defined by the patentee. It is therefore evident that the particular illustrative embodiments disclosed above may be altered or modified and all such variations are considered within the scope and spirit of the present disclosure.

What is claimed is:

1. A subsurface safety valve, comprising:

a tool body positionable in a wellbore and having an upper end for coupling to a tubing string, a lower end, and a through bore between the upper and lower ends for conveying fluid;

a valve closure element coupled to the lower end of the tool body and moveable between an open position and a closed position;

a flow tube disposed in the tool body and axially moveable between a first axial position putting the valve closure element in the open position and a second axial position allowing the valve closure element to move to the closed position, the flow tube including an interior flow bore for conveying the fluid from the tubing string; and an external flow tube profile formed on the flow tube defining an annulus between the flow tube and tool body, the external flow tube profile including an upper shoulder for engagement with a wiper in the first axial position, a lower shoulder for engagement with the wiper in the second axial position, and a clearance path between the upper and lower shoulders for allowing a viscous fluid trapped in the annulus to flow past the wiper when the flow tube is in-between the first and second axial positions, wherein the clearance path is axially spaced from the valve closure element throughout a range of travel between the first and second axial positions.

2. The subsurface safety valve of claim 1, wherein the clearance path comprises a plurality of axially-extending, circumferentially-spaced channels along the external flow tube profile between the upper and lower shoulders.

3. The subsurface safety valve of claim 1, wherein the clearance path comprises a plurality of axially-extending flats between the upper and lower shoulders.

4. The subsurface safety valve of claim 1, wherein the clearance path comprises a continuous, reduced-diameter portion between the upper and lower shoulders.

5. The subsurface safety valve of claim 1, wherein an annular gap between the flow tube and the wiper is at least 10 mm along the clearance path.

6. The subsurface safety valve of claim 1, wherein the valve closure element comprises a flapper pivotable to an open position in response to positioning of the flow tube in the first axial position and to a closed position in response to positioning of the flow tube in the second axial position.

7. The subsurface safety valve of claim 1, wherein the tool body comprises a top sub and a bottom sub for releasably coupling the tool body to a completion string.

8. The subsurface safety valve of claim 1, wherein the wiper comprises a wiper ring supported by a wiper seat.

9. A subsurface safety valve, comprising:

a tool body positionable in a wellbore and having an upper end for coupling to a tubing string, a lower end, and a through bore between the upper and lower ends for conveying fluid;

a valve closure element coupled to the lower end of the tool body and moveable between an open position and a closed position;

a flow tube disposed in the tool body and axially moveable between a first axial position putting the valve closure element in the open position and a second axial position allowing the valve closure element to move to the closed position, the flow tube including an interior flow bore for conveying the fluid from the tubing string;

an external flow tube profile formed on the flow tube defining an annulus between the flow tube and tool body, the external flow tube profile including an upper shoulder for engagement with a wiper in the first axial position, a lower shoulder for engagement with the wiper in the second axial position, and a clearance path between the upper and lower shoulders for allowing a viscous fluid trapped in the annulus to flow past the wiper when the flow tube is in-between the first and second axial positions; and wherein the flow tube comprises a flow tube extension on an upper end defining the clearance path of the external flow tube profile, wherein the wiper is positioned in an annulus between the flow tube extension and the tool body.

10. The subsurface safety valve of claim 9, wherein a portion of the flow tube from which the flow tube extension extends is wider than the flow tube extension and rides in a wider portion of the tool body than the flow tube extension, with an annular gap defined between the flow tube extension and the wider portion of the tool body when the flow tube is in the first axial position, and wherein the flow tube fills at least a portion of the annular gap when moving to the second axial position to urge trapped fluid out of the annular gap and across the wiper.

11. A downhole tool actuator, comprising:

an actuator body disposable in a wellbore and having an upper end for coupling to a tubing string, a lower end, and a through bore between the upper and lower ends for conveying fluid;

a flow tube disposed in the actuator body and axially moveable within the actuator body between a first axial position and a second axial position for actuating a downhole tool when coupled to the actuator body, the flow tube including an interior flow bore for conveying fluids through the actuator body; and an external flow tube profile on the flow tube defining an annulus between the flow tube and actuator body, the external flow tube profile including an upper shoulder for engagement with a wiper in the first axial position, a lower shoulder for engagement with the wiper in the second axial position, and a clearance path comprising a plurality of axially-extending flats between the upper and lower shoulders for allowing a viscous fluid trapped in the annulus to flow past the wiper when the flow tube is moved between the first and second axial positions.

12. The downhole tool actuator of claim 11, wherein the tool comprises a valve including a moveable closure element moveable by the flow tube between an open position and a closed position.

13. The downhole tool actuator of claim 11, wherein the clearance path comprises a plurality of axially-extending, circumferentially-spaced channels along the external flow tube profile between the upper and lower shoulders.

14. The downhole tool actuator of claim 11, wherein the clearance path comprises a continuous, reduced-diameter portion between the upper and lower shoulders.

15. A method of operating a downhole tool, the method comprising:

lowering the downhole tool into a wellbore on a tubing string;

flowing a fluid through the tubing string and through a flow tube with the flow tube in a first axial position within a tool body;

blocking flow between the flow tube and the tool body with a wiper while in the first axial position;

moving the flow tube from the first axial position to a second axial position to actuate the downhole tool; and while moving the flow tube to the second axial position, passing fluid trapped in an annulus between the flow tube and the tool body of the downhole tool under the wiper along a reduced-diameter clearance path between the flow tube and the tool body.

16. The method of claim 15, wherein the step of passing fluid trapped between the flow tube and a body of the downhole tool under the wiper comprises passing the trapped fluid along a plurality of axially-extending, circumferentially-spaced channels along the flow tube.

17. The method of claim 15, wherein the step of passing fluid trapped between the flow tube and a body of the downhole tool under the wiper comprises passing the trapped fluid along a plurality of axially-extending flats along the flow tube.

18. The method of claim 15, wherein the step of passing fluid trapped between the flow tube and a body of the downhole tool under the wiper comprises passing the trapped fluid along a continuous, reduced-diameter portion of the flow tube.

* * * * *